US005453039A

United States Patent [19]

Weintraub

[11] Patent Number: 5,453,039

[45] Date of Patent: Sep. 26, 1995

[54] SMALL PARTS ABRASION CLEANING BASKET

[76] Inventor: Peter Weintraub, 1860 Joe Crosson Dr., El Cajon, Calif. 92020

[21] Appl. No.: 173,070

[22] Filed: Dec. 27, 1993

[51] Int. Cl.[6] ..... B24C 7/00

[52] U.S. Cl. ..... 451/75; 451/89; 451/90; 451/326

[58] Field of Search ..... 451/38, 39, 40, 451/75, 89, 90, 326, 327, 328, 329, 103, 104, 105, 106, 107, 113; 15/3.15, 268; 134/92, 135, 151, 153

[56] References Cited

U.S. PATENT DOCUMENTS 3,041,786 7/1962 Schnetzer ..... 451/89
3,041,787 7/1962 Schnetzer ..... 451/89
4,300,318 11/1981 Brown ..... 451/89
5,143,102 1/1992 Blaul ..... 451/89

*Primary Examiner*—Maurina T. Rachuba

[57] ABSTRACT

A small parts abrasion cleaning basket having a tubular neck portion and a tubular main body housing. The bottom end of the neck portion has an outlet port that is in communication with the top end of the main body housing. A wire screen having a concave top surface has its outer edges secured to the inner wall surface of the main body housing. The area between the top edge of the main body housing and the top surface of the wire screen forms an abrasion chamber for cleaning small parts preparatory to painting, coating, etc. The small parts abrasion cleaning basket would be used inside an abrasive blast cleaning cabinet where it would be held by a person's hand inserted into rubber or plastic gloves within the cabinet.

7 Claims, 1 Drawing Sheet

SMALL PARTS ABRASION CLEANING BASKET

BACKGROUND OF THE INVENTION

The novel invention relates to a cleaning basket and more specifically a small parts abrasion cleaning basket that would be used by a person inside an abrasive blast cleaning cabinet.

With present abrasive blast cleaning cabinets, it is very difficult for the person cleaning the parts to hold them within the cabinet while a flow of abrasive material is being directed against the parts. Often the parts are knocked out of the person's hand which requires them to be located and picked up again. Sometimes these small parts end up blocking passages in the abrasive blast cleaning cabinet. There are also times when the small parts get lost in the abrasive collector bin.

When the small parts have an aperture in them, it is common for the operator to run a wire through several of these pieces and then hang them in the abrasive blast cleaning cabinet while the flow of abrasive material is directed against them. Some people even use a cardboard box and poke holes in the bottom of the box and insert bolts, screws, etc. into these holes and then the pressurized abrasive material is directed against the parts. Any of the area of the parts that are in these respective holes does not get cleaned.

Another problem in using present day abrasive blast cleaning cabinets is that the light is not the greatest inside the cabinet. Also sometimes the dust obscures the surface of the parts and you cannot see if they are clean.

It is an object of the invention to provide a novel small parts abrasion cleaning basket that allows the small parts to be concentrated in the center of the wire screen while they are being blasted with abrasive material which also facilitates the agitating of these small parts so that their entire surfaces may be cleaned.

It is also an object of the invention to provide a novel small parts abrasion cleaning basket that is designed with a tubular neck portion that tapers from its top edge inlet port inwardly to its bottom edge outlet port thereby accelerating the abrasive dust through the basket and out its bottom as the result of a venturi effect.

It is another object of the invention to provide a novel small parts abrasion cleaning basket that is very lightweight and easy to use.

It is an additional object of the invention to provide a novel small parts abrasion cleaning basket that is economical to manufacture and market.

SUMMARY OF THE INVENTION

The novel small parts abrasion cleaning basket has been designed for use by a person using an abrasive blast cleaning cabinet. These cabinets have a pair of arm holes in their front wall through which the person inserts his hands into rubber or plastic gloves. The top cover of the cabinet can be opened so that the person can hold in one of their hands the part to be cleaned by the pressurized abrasive blast. There is a window in the cover so that the person can view the abrasive blasting operation.

The novel basket has been designed for use in cleaning small parts that are difficult to hold in a person's hand and parts which cannot have a wire inserted into them for hanging them in the cabinet. The basket would normally be held in one of the person's hand with a small number of small parts inserted therein. Since the top surface of the wire screen has a concave curvature, the parts tend to concentrate in the center thereof. The person holding the basket can agitate or shake the basket while they are being shot with abrasive material to insure that all the surfaces of the parts are cleaned. If the parts are by a blast that forces them to the outer surface of the wire screen, the tendency is for them to ride upwardly along the inner cylindrical walls of the main body housing and upwardly along the curved top edge of the main body housing where they would be intercepted by the bottom edge of the tubular neck portion. Since the bottom edge of the tubular neck portion extends downwardly into the main body housing, this prevents the small parts from being blasted and directed upwardly in a reverse direction up through the tubular neck portion.

The tubular neck portion has a configuration in the shape of an inverted cone section. The top edge forms an abrasive material inlet port and the bottom edge forms an abrasive outlet port. Since the side walls taper inwardly, the abrasive material and its dust accelerates through the basket and out its bottom due to a venturi effect, This downward pull or sucking of the dust prevents it from coming back up and exiting the top inlet port, This helps the visibility in the abrasive blast cleaning cabinet and this is quite important since the light is not the greatest inside the cabinet.

DESCRIPTION OF THE PREFERRED EMBODIMENT

Figure 1:
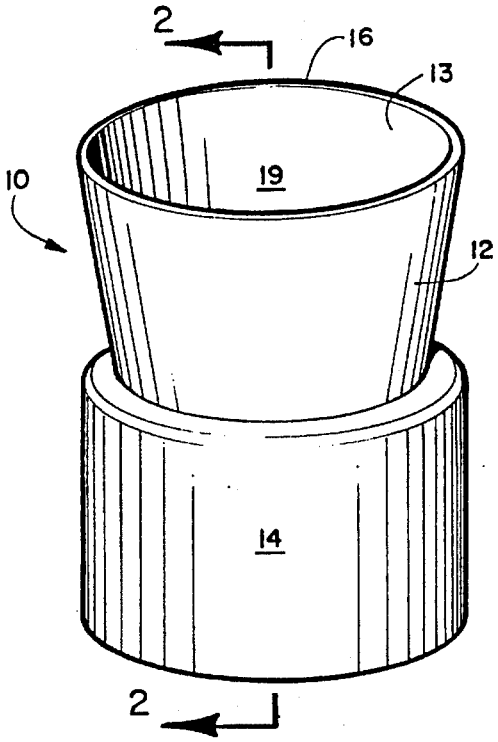
FIG. 1 is a front perspective view of the novel small parts abrasion cleaning basket.
Figure 2:
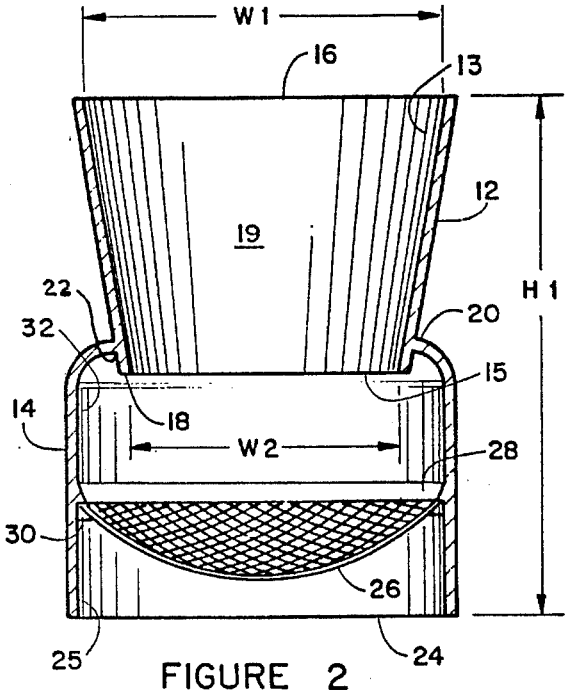
FIG. 2 is a vertical cross section through the small parts abrasion cleaning basket.
Figure 3:
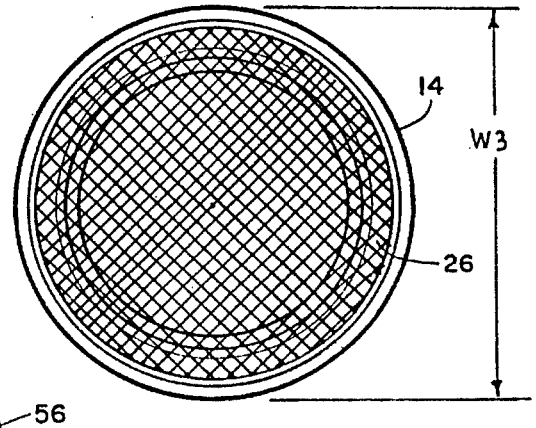
FIG. 3 is a bottom plan view of the novel small parts abrasion cleaning basket.

The novel small parts abrasion cleaning basket will now be described by referring to FIGS. 1–4. The basket is generally designated numeral 10.

The small parts abrasion cleaning basket 10 has a tubular neck portion 12 and a main body housing 14, The neck portion 12 has a top edge 16, a bottom edge 18 and side walls 19, The top end of tubular neck portion 12 forms an abrasive inlet 13 port and the bottom end forms an abrasive outlet port 15, The top end of neck portion 12 has a width W1 that is larger than the bottom edge width W2.

Main body housing 14 has a top edge 20 with an opening 22 formed therein which receives the bottom end of tubular neck portion 12. Main body housing 14 has a bottom edge 24 that forms abrasive material outlet port 25. The width of the bottom end of main body housing 14 is W3 and this is greater than W1. A wire screen 26 has a concave top surface and its peripheral edge is set against a shoulder 28 on the inner wall surface of main body housing 14. A ring 30 would be glued in position to prevent the wire screen from being forced outwardly through the abrasive material outlet port. The area between the top edge 20 and wire screen 26 forms an abrasion chamber 32. The total height of the basket is H1. In one preferred embodiment of the small parts abrasion cleaning basket, H1=4", W1=3¼", W2=3", and W3= 3⅝. Wire screen 26 would have a ⅛" mesh.

Figure 4:
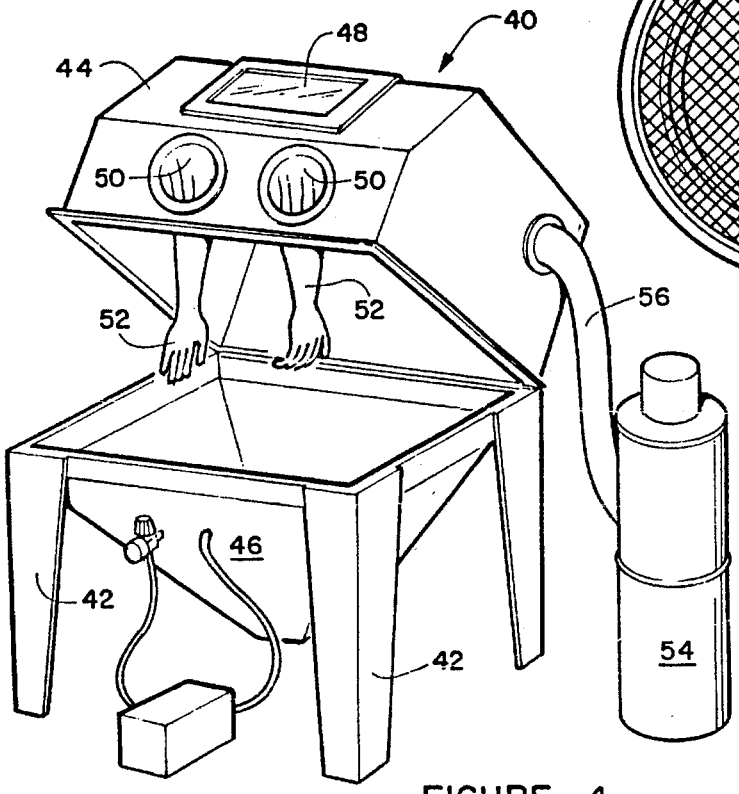
FIG. 4 is front perspective view of a typical abrasive blast cleaning cabinet.

A typical abrasive blast cleaning cabinet 40 is illustrated in FIG. 4. It has a base 42, a cover 44, and an abrasive collector bin 46. Cover 44 has a viewing window 48, arm apertures 50, and gloves 52. A pressurized container 54 is connected to cover 44 by tube 56.

What is claimed is:

1. A small parts abrasion cleaning basket comprising:

a tubular neck portion having a top edge defining an inlet port and a bottom edge defining an outlet port, said neck portion having a bottom end;

a tubular main body housing having a top edge and also a bottom edge that defines an outlet port, the top edge of said main body housing having an opening for receiving the bottom end of said neck portion so that the outlet port of said neck portion is in communication with the interior of said main body housing, said main body housing having an inner wall surface;

a screen having a predetermined outer edge configuration, said screen having a concave top surface; and means for securing the outer edges of said screen to the inner wall surface of said main body housing.

2. A small parts abrasive cleaning basket as recited in claim 1 wherein the bottom edge of said neck portion is positioned a predetermined distance below the top edge of said main body housing.

3. A small parts abrasive cleaning basket as recited in claim 1 wherein said neck portion has the shape of a section of an inverted cone.

4. A small parts abrasion cleaning basket as recited in claim 1 wherein said main body housing has a cylindrical shape.

5. A small parts abrasion cleaning basket as recited in claim 1 wherein said neck portion and said main body portion are made of plastic.

6. A small parts abrasion cleaning basket as recited in claim 1 wherein said screen is made of wire.

7. A small parts abrasion cleaning basket as recited in claim 1 wherein the bottom of said screen is positioned above the bottom edge of said main body housing.

* * * * *